US011027288B2

(12) United States Patent
Wolfs et al.

(10) Patent No.: US 11,027,288 B2
(45) Date of Patent: Jun. 8, 2021

(54) DEVICE AND METHOD FOR MAGNETIC SEPARATION

(71) Applicant: MHD Technologies B.V., Oud-Beijerland (NL)

(72) Inventors: Paulus Wolfs, Oud-Beijerland (NL); Robbie Hagelstein, Rotterdam (NL)

(73) Assignee: MHD Technologies B.V., Oud-Beijerland (NL)

( * ) Notice: Subject to any disclaimer, the term of this patent is extended or adjusted under 35 U.S.C. 154(b) by 169 days.

(21) Appl. No.: 16/331,536

(22) PCT Filed: Sep. 11, 2017

(86) PCT No.: PCT/NL2017/050591
§ 371 (c)(1),
(2) Date: Mar. 8, 2019

(87) PCT Pub. No.: WO2018/048304
PCT Pub. Date: Mar. 15, 2018

(65) Prior Publication Data

US 2019/0201913 A1 Jul. 4, 2019

(30) Foreign Application Priority Data

Sep. 9, 2016 (NL) ..... 2017443

(51) Int. Cl.
*B03C 1/30* (2006.01)
*B03C 1/005* (2006.01)
(Continued)

(52) U.S. Cl.
CPC ..... *B03C 1/286* (2013.01); *B03C 1/005* (2013.01); *B03C 1/284* (2013.01); *B03C 1/288* (2013.01);
(Continued)

(58) Field of Classification Search
CPC ..... B03C 1/005; B03C 1/286; B03C 1/284; B03C 1/288; B03C 1/30; B03C 2201/18; B03D 3/06
(Continued)

(56) References Cited

U.S. PATENT DOCUMENTS 6,077,333 A * 6/2000 Wolfs ..... B03C 1/0332 96/1
6,099,738 A * 8/2000 Wechsler ..... C02F 1/48 210/222
(Continued)

FOREIGN PATENT DOCUMENTS

CN 1227821 A 9/1999
EP 0440798 A1 * 8/1991 ..... B03C 1/034
(Continued)

OTHER PUBLICATIONS

Jan Svoboda: "Chapter 3.6: Magnetic flocculation" In: "Magnetic Techniques for the Treatment of Materials", May 19, 2004 (May 19, 2004), Kluwer Academic Publishers, Dordrecht, The Netherlands, XP055369175, ISBN: 978-1-4020-2038-4, pp. 208-221, p. 208-p. 210

*Primary Examiner* — Terrell H Matthews
(74) *Attorney, Agent, or Firm* — N.V. Nederlandsch Octrooibureau; Catherine A. Shultz; Katelyn J. Bernier

(57) ABSTRACT

The invention relates to an apparatus for removing magnetizable particles in a substance, the apparatus comprising a magnetic separation chamber for filtering magnetizable particles and flocs from the substance, wherein the magnetic separation chamber comprises a first housing that defines a first space through which the substance can flow, as well as at least one first magnet of which a first magnetic field reaches into the first space, and which first magnet is located within a first holder that has an interface with the first space; and a flocculation chamber for inducing flocculation of the
(Continued)

particles in a substance, the flocculation chamber being in fluid connection with the magnetic separation chamber; wherein the magnetic separation chamber is located downstream of the flocculation chamber, and wherein the flocculation of the magnetizable particles results in magnetizable flocs, and the magnetic field of the first magnet causes the magnetizable flocs to be attracted towards the first magnet, thereby removing the flocs of magnetizable particles from the substance.

20 Claims, 10 Drawing Sheets

(51) Int. Cl.
*B03C 1/28* (2006.01)
*B03D 3/06* (2006.01)

(52) U.S. Cl.
CPC ..... *B03C 1/30* (2013.01); *B03D 3/06* (2013.01); *B03C 2201/18* (2013.01); *B03C 2201/28* (2013.01)

(58) Field of Classification Search
USPC ..... 209/5, 509, 606
See application file for complete search history.

(56) References Cited

U.S. PATENT DOCUMENTS

| | | | | |
|---|---|---|---|---|
| 2012/0043264 | A1 | 2/2012 | Isogami et al. | |
| 2019/0201913 | A1 * | 7/2019 | Wolfs | B03C 1/30 |

FOREIGN PATENT DOCUMENTS

| | | | | | |
|---|---|---|---|---|---|
| EP | 0440798 | A1 | | 8/1991 | |
| GB | 2317126 | | * | 3/1998 | B03C 1/30 |
| GB | 2317126 | A | * | 3/1998 | B21B 45/0293 |
| GB | 2317126 | A | | 3/1998 | |
| JP | 2016007584 | A | | 1/2016 | |

* cited by examiner

DEVICE AND METHOD FOR MAGNETIC SEPARATION

BACKGROUND OF THE INVENTION

Field of the Invention

The invention relates to an apparatus for removing magnetizable particles in a substance by means of magnetic separation. The invention further relates to a device for pre-magnetizing magnetizable particles. Furthermore, the invention relates to a method of removing magnetizable particles from a substance by means of magnetic separation.

Description of the Related Art

The application of substances such as paint, primer, degreasing and rinsing fluids to surfaces is a common manufacturing step across a diverse range of industries, such as automobile manufacturing. Some techniques for applying substances to surfaces include spray painting, spray coating, airbrushing and dip coating. In implementing these techniques, it is desirable to have compositions which are substantially free from impurities.

However, such compositions become contaminated due to, for example, the actual manufacturing process i.e. welding, shaving, drilling, deburring etc. or from displacement along conveying equipment such as pipes or tubes which may release particles as a result of friction with the substance or by contact with the painted object. Such particles which are inherent to the manufacturing process, will have a negative impact on the quality and finish of the application, and can lead to issues such as rust formation (in the case of iron particles), and gaps in a coloring or functional coating/finish due to the interfering particles.

Therefore, such substances are commonly treated prior to or during application in order to remove undesirable particles.

Magnetic separation is one technique which is employed in the removal of metallic particles, and which involves the application of a magnetic field within a substance resulting in magnetization, the metallic particles are drawn from the substance and onto a particle collecting element.

However, this technique has proven less effective in the removal of particles of a smaller size and of particles of a paramagnetic material, which are more resistant to magnetization. This is the case, for example, with (sub)micron-sized particles or for mixed steel/aluminum production. Recent advances in technology have led to development of increasingly thinner coatings applied to compositions. This requires more efficient filtration methods of the substances especially in the lower micron-size range of impurities. Smaller particles are less susceptible to the regular magnetic fields in separators, such that these smaller particles remain in the substance flow and may cause damage and/or failure in the long run.

Therefore, there is a need for separation techniques which can achieve particle removal at a higher resolution or degree, and which provides removal that is effective throughout a broader range of particle sizes and materials.

It would therefore be desirable to provide an improved apparatus for separating particles from a substance that alleviated some or all of the above problems. Therefore, it is an object of the invention to provide an improved device and method by which to effectively remove metallic impurities or contaminants from a substance, and in particular particles of a relatively small size.

BRIEF SUMMARY OF THE INVENTION

This is achieved by providing an apparatus for removing magnetizable particles in a substance, the apparatus comprising:

a magnetic separation chamber for filtering magnetizable particles and flocs from the substance, wherein the magnetic separation chamber comprises a first housing that defines a first space through which the substance can flow, as well as at least one first magnet of which a first magnetic field reaches into the first space, and which first magnet is located within a first holder that has an interface with the first space; and a flocculation chamber for inducing flocculation of the particles in a substance, the flocculation chamber being in fluid connection with the magnetic separation chamber;

wherein the magnetic separation chamber is located downstream of the flocculation chamber, and wherein the flocculation of the magnetizable particles results in magnetizable flocs, and the magnetic field of the first magnet causes the magnetizable flocs to be attracted towards the first magnet, thereby removing the flocs of magnetizable particles from the substance.

By forcing the magnetizable particles to form flocs, the magnetizable parts, i.e. particles and/or flocs, to be removed by the magnetic separator will be larger than the original magnetizable particles. In particular for (sub)micron-sized particles or paramagnetic particles, the magnetic separator can have problems removing these particles without any pre-treatment to increase the removal efficiency. By floccing these small particles together, the magnetic field of the magnet in the magnetic separator, i.e. the first magnet, is large enough to get hold of the flocs and to separate the flocs from the substance. Floccing may be achieved by the addition of inorganic electrolytes or polymers, or by magnetic flocculation.

In an embodiment, the flocculation chamber comprises a second housing that defines a second space through which the substance can flow, as well as at least one second magnet of which a second magnetic field reaches into the second space, and which second magnet is located within a second holder that has an interface with the second space, and wherein the magnetic field of the second magnet causes the magnetizable parts to be attracted to each other, thereby undergoing flocculation and forming flocs.

A preferred way to form flocs of the magnetizable particles is by means of a second magnetic field induced by a second magnet in the flocculation chamber. The second magnetic field is large enough to magnetize the particles enough to floc together and form flocs, i.e. larger magnetizable parts. Preferably, the flocculation chamber is arranged immediately adjacent to the magnetic separation chamber. This may be achieved when the flocculation chamber and the magnetic separation chamber are integrally formed, this can be by using flanges, welds, glue or any other sort of connections. They can be separate parts or a monolithic integral element.

In that case the flocs formed in the flocculation chamber travel only a short distance. The rate of flocculation is determined by the interplay between the dipolar magnetism induced by the magnetic field that flocs the particles, and the hydrodynamics of the substance flow that tend to disintegrate the flocs.

When the applied magnetic field is large enough, the attractive magnetic energy will be greater than the sum of the repulsive energy and the particle will tend to form aggregates, i.e. flocs. Another condition to be satisfied is that the time needed to floc is smaller than the residence time of the particles in the second magnetic field. The second magnetic field should not be too large in combination with a too low substance flow, as the flocculation chamber may then act as magnetic separator.

The adhesion strength of the aggregates or flocs must be adequately large to prevent them from breaking up by the fluid shear stress induced by the hydrodynamics of the substance flow. To efficiently counteract this disintegration, the flocculation magnetic field, i.e. the second magnetic field, in the flocculation chamber has to be designed in such a way that the flocculating magnetic field is kept at a minimum distance from the main magnetic field, i.e. the separating or first magnetic field.

Furthermore, in a turbulent flow the flocs will undergo more disintegration forces than in a laminar flow. Maintaining a laminar flow between the flocculation field and the main separation field is another condition to be satisfied.

In order to have the first and/or second magnetic fields extend into the first and/or second space, the first and/or second holders may extend into the first and/or second spaces, respectively. Preferably, each first and/or second holder comprises a tube that is closed at an end that extends into the first and/or second space, respectively.

In that case, the first and/or second magnets may have a rod shape, that have a releasable fit into the first and/or second holder. As the magnets extend into the space, the respective magnetic fields also extend into the space of the chambers, being the flocculation and/or magnetic separation chamber.

The first and/or second holder may have a top side from which each tube extends into the first and/or second space, respectively. The magnetizable particles or flocs may accumulate now on the outside of the first and/or second holders, as a result of which the magnets themselves are not exposed to the substance and/or the magnetizable particles.

Preferably, the first and/or second magnets are connected to a moving mechanism to move the first and/or second magnet with respect to the first and/or second space, respectively. The moving mechanism can remove the first and/or second magnet from the holder. As a result of removing the magnet from the holder, the magnetic field in the space is removed or at least decreased in strength so that the holder can be cleaned in a simple manner.

The housing of the magnetic separation chamber may further comprise a removable attachment, wherein the magnetic elements of the magnetic separation chamber are connected to the attachment. The housing further comprises one or more holders for respectively holding the one or more magnetic elements.

When the magnets are raised out of their holder, the magnetic field decreases considerably in the liquid in the magnetic space, as a result of which the particles accumulated on the outside of the holders can easily be removed. In order to ensure that the material does not enter the cleaned liquid again, a bottom wall of at least one of the chambers may be provided with a discharge for removing magnetizable parts which have accumulated on the outside of each tube.

According to an embodiment, the housing of the flocculation chamber is provided with an inlet part that is connectable to a conduit system through which the substance flows, and wherein the housing of the magnetic separation chamber is provided with an outlet part that is connectable to the conduit system. Preferably, the inlet part widens out to the flocculation chamber to decrease a flow rate of the substance flowing into the flocculation chamber.

For the particles to form aggregates or flocs in the flocculation field the magnetic field of the second magnet has to be sufficiently large and the time the particles spend in the flocculation field should be longer than the time it takes to form aggregates from the particles. The residence time of the particles in the flocculation field is increased by an enlarged diameter of the inlet with respect to that of the conduit system. This reduces the flowrate of the substance and therefore increases the residence time of the particles in the flocculation field. Preferably, the second magnetic field is low enough to prevent the particles to accumulate on the second holder, but high enough that the particles are magnetized and thereby attracted to each other to form aggregates.

After the magnetic separation chamber, the substance may flow into the conduit system again. Therefore, the outlet part may taper away from the magnetic separation chamber. The outlet part then again reduces the diameter of the piping to be compatible with the conduit system.

The first space of the magnetic separation chamber may define a spatial volume which is greater than the spatial volume defined by the second space of the flocculation chamber. The larger the spatial volume of a chamber, the more the flow rate is reduced and the longer the residence time in the chamber. As such, the residence time in the magnetic separation chamber may be longer than that in the flocculation chamber. This is to increase the separation efficiency of the magnetic separation chamber by allowing more time for accumulation of the parts on the first holder.

A longitudinal direction of the one or more first and/or second holders may be substantially perpendicular to a downstream direction from the flocculation chamber towards the magnetic separation chamber. Additionally or alternatively, a direction of the first and/or second magnetic fields may be substantially perpendicular to the downstream direction.

Alternatively, the longitudinal direction of the one or more first and/or second holders may be substantially parallel to a downstream direction from the flocculation chamber towards the magnetic separation chamber. Additionally or alternatively, a direction of the first and/or second magnetic fields may be substantially parallel to the downstream direction.

Alternatively, the longitudinal directions of the one or more first and/or second holders may differ, such that the holders are arranged in a combination of substantially perpendicular and substantially parallel longitudinal directions with respect to the downstream direction from the flocculation chamber towards the magnetic separation chamber. Additionally or alternatively, a direction of the first and/or second magnetic fields may comprise a combination of substantially perpendicular and substantially parallel directions with respect to the downstream direction.

As used herein, longitudinal direction refers to that direction along which a length of the respective element is greatest, that is, the direction along the long axis of a body.

To counteract the disintegration of the aggregates formed in the flocculation field the distance of this field to the main separation field is kept at a minimum and the flow pattern is kept within a regime of unseparated flow. The flocculation field is mounted as close as possible to the magnetic separation chamber with the main separation field. With an average incoming flow velocity of between 1-4 m/s, preferably about 2 m/s, the time between leaving the flocculating magnetic field and reaching the main separating magnetic field is between 0.1 and 1 second, preferably between 0.1-0.4 second. The magnitude of the magnetic field provided by each of the one or more first magnets of the magnetic separation chamber may be between 0.03 and 1 Tesla.

A cross section of the second holder of the second magnet has a greater dimension in the downstream direction with respect to a dimension in a direction transverse to the downstream direction. In order to keep a laminar flow between the flocculation field and the main separation field the outer tubes of the flocculation unit have a major dimension in the downstream direction. Preferably, the second holder of the second magnet has an oval cross section, wherein a major axis of the oval cross section is directed in the downstream direction. Computational Fluid Simulations on this design have proven that the use of oval shaped tubes significantly contribute to maintaining a laminar flow at Reynolds numbers smaller than 5.

The cross section of the first magnets may be circular. However, the cross section of the first and/or second magnets may be any kind of shape suitable for magnetic separation or flocculation. The cross section of the first and/or second holders may be similar to that of the respective magnets. Alternatively, the first and/or second holders have distinct cross section from that of the respective magnets.

The flocculation chamber may be configured to induce flocculation of particles in the smaller range of particles present in the substance, preferably having a size equal or smaller than 15 micrometer, more preferably of particles having a size in the order of 3 to 10 micrometers.

In magnetic separation of alkaline degreasing fluids, the process of magnetic flocculation plays a positive role by increasing the efficient recovery of ferritic particles from 3 to 15 micron. The effect for paramagnetic particles will be relatively lower albeit still enhances capturing these particles in the matrix of ferromagnetic particles. The process of magnetic flocculation may also play a positive role in the recovery of ferromagnetic of other sizes, as well as recovery of paramagnetic particles.

The invention further relates to a device for pre-magnetizing magnetizable particles, the device comprising a flocculation chamber for inducing flocculation of the particles in a substance, the flocculation chamber being fluidly connectable to a magnetic separation chamber located downstream from the flocculation chamber, wherein the flocculation chamber comprises a housing that defines a space through which the substance can flow, as well as at least one magnet of which a magnetic field reaches into the space, and which magnet is located within a holder that has an interface with the space;

wherein the magnetic field of the magnet causes the magnetizable particles to be attracted to each other, thereby undergoing flocculation and forming flocs.

By having the process medium flow through the flocculation field first, the medium and the pollution in the medium will be distributed more evenly through the magnetic separation chamber. Because of this better medium distribution the flow velocity in the magnetic separation chamber will be reduced, which leads to more efficient separation.

The device may further comprise an inlet part that is connectable to a conduit system through which the substance flows; and one or more flanges for connection to the magnetization chamber. Preferably, the inlet part widens out into the flocculation chamber to decrease a flow rate of the substance flowing into the flocculation chamber. The residence time of the particles in the flocculation field is increased by an enlarged diameter of the inlet with respect to that of the conduit system. This reduces the flowrate of the substance and therefore increases the residence time of the particles in the flocculation field.

The device may be an (integral) part of a magnetic particle separation system or the device is configured for retrofitting into a magnetic separation system, an existing magnetic separation system or any other system, method, or technology for separation, for instance by combination with a pre-installed magnetic separator chamber.

The invention furthermore relates to a method of removing magnetizable particles from a substance, the method comprising the steps of:

- inducing flocculation of the magnetizable particles in the substance to produce flocs in a flocculation chamber;
- providing a first magnetic field in order to magnetize the flocs;
- conveying the substance through a magnetic separation chamber to remove the magnetized flocs from the substance.

The method may further comprise the step of inducing flocculation providing a second magnetic field applied in the flocculation chamber. Forming the flocs is thus done by means of magnetic flocculation.

Preferably, the method comprises the step of reducing a flow rate of the substance prior to and/or during the step of forming flocs. By reducing the flow rate of the substance, the time for forming flocs, i.e. the residence time in the flocculation chamber, is increased and the flocculation efficiency is increased.

After the flocculation and the separation step, the method may further comprise cleaning the magnetic separation chamber and/or the flocculation chamber. During the process, some of the magnetizable particles may adhere in the respective chamber. This may impair the flocculation and/or separation process. Cleaning the respective chamber will enhance the efficiency of the further separation process. Preferably, cleaning any of the chambers comprises removing the respective magnets from the chamber. By removing the magnetic field from the respective chamber, the magnetizable particles remaining there will not be under the influence of the magnetic field anymore. Thus, the cleaning process of the respective chamber is facilitated. Further, cleaning of any of the chambers comprises using the substance flow or injecting a pressurized fluidum into any of the chambers.

Preferably, the method is used for an apparatus as described above for removing magnetizable particles in the substance.

In an embodiment, a method is provided for removing magnetizable particles from a substance, the method comprising the steps of

- inducing flocculation of the magnetizable particles in the substance to produce flocs;
- providing a first magnetic field in order to magnetize the flocs and single particles;
- conveying the substance through a magnetic separation chamber to remove the magnetized flocs and single particles from the substance. The term single particles as used herein refers to those particles which have not been formed or joined into a floc.

In an embodiment, the step of inducing flocculation comprises providing a second magnetic field applied in the flocculation chamber.

In an embodiment, the method further comprises the step of reducing the flow velocity of the substance prior to and/or during the step of forming flocs and during the step of separation in the magnetic separation chamber.

In an embodiment, the method further comprises the step of cleaning the magnetic separation chamber and/or the flocculation chamber.

In an embodiment, the step of cleaning any of the chambers comprises removing the respective magnets from the chamber.

In an embodiment, the step of cleaning of any of the chambers comprises using the substance flow or injecting a pressurized fluidum into the any of the chambers.

BRIEF DESCRIPTION OF THE DRAWINGS

FIG. 5*a* shows a schematic view of a magnetic separation system according to the invention during active filtration prior to a cleaning process.

FIG. 5*b* shows a schematic view of the magnetic separation system according to the invention during a first step of the cleaning process.

FIG. 5*c* shows a schematic view of the magnetic separation system according to the invention during a second step of the cleaning process.

FIG. 5*d* shows a schematic view of the magnetic separation system according to the invention during a spray cleaning step of the cleaning process.

DESCRIPTION OF ILLUSTRATIVE EMBODIMENTS

Figure 1:
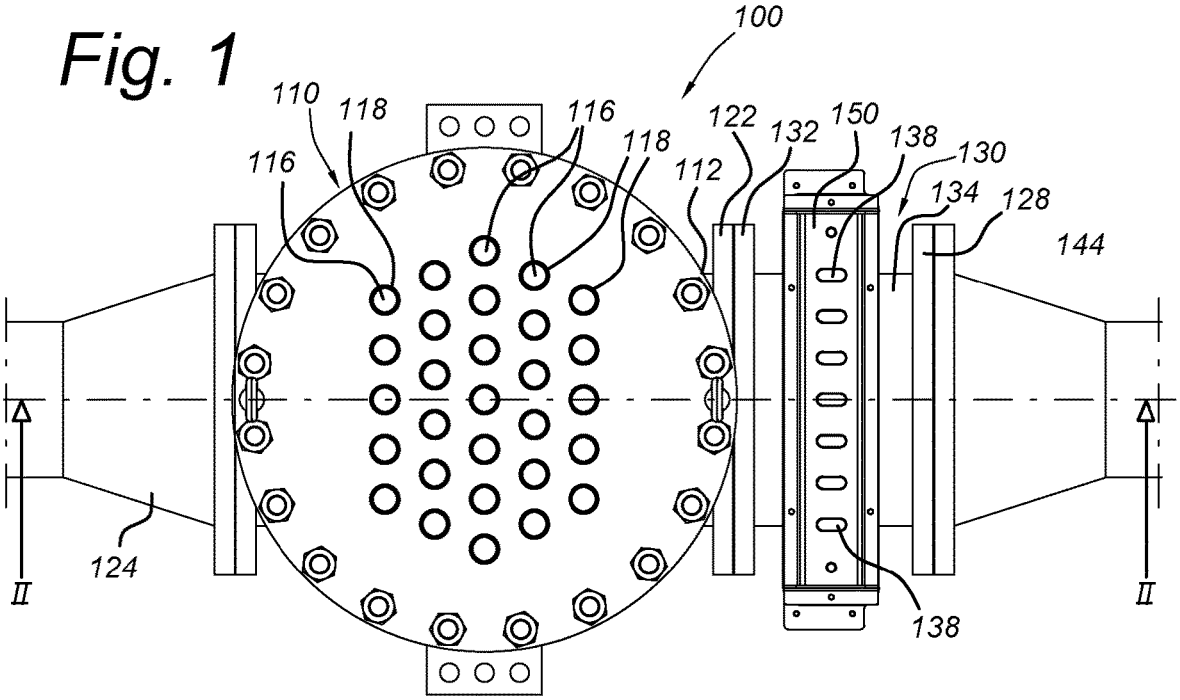
FIG. 1 shows a top view of an apparatus for magnetic separation according to the invention.
Figure 2:
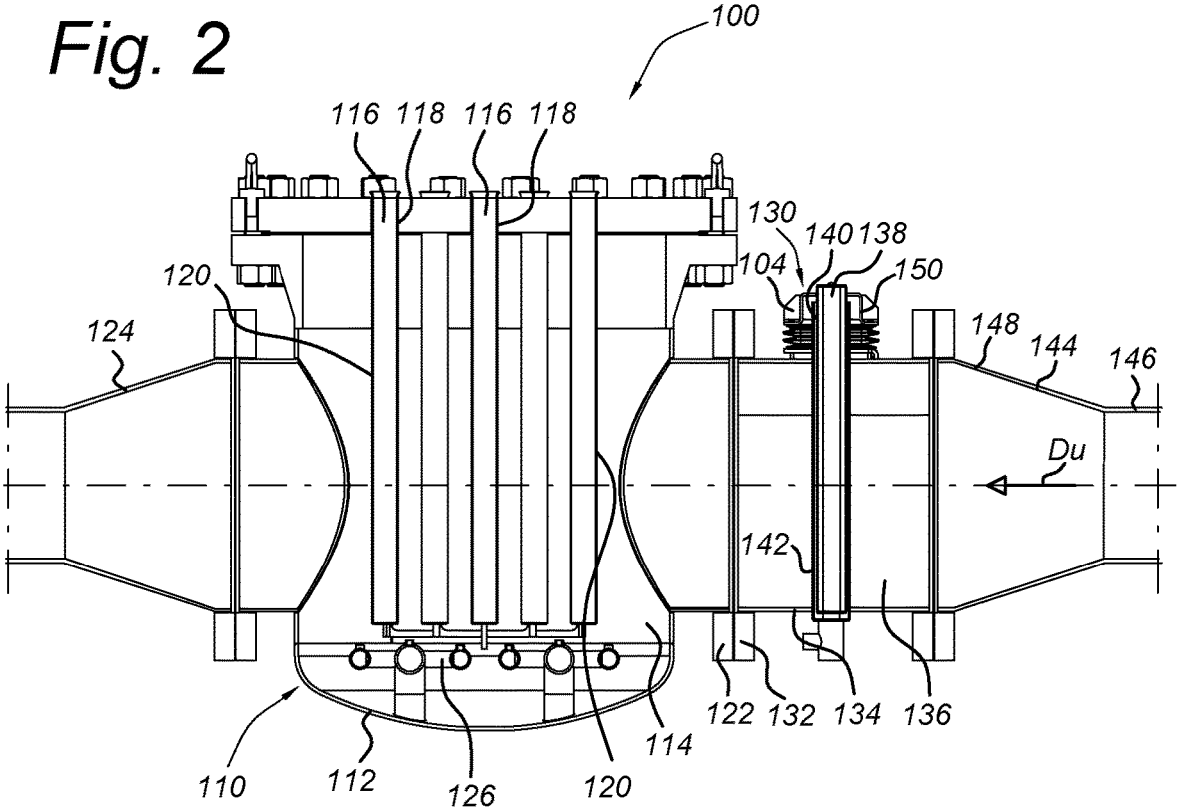
FIG. 2 shows a cross section along line A-A of the apparatus of FIG. 1.
Figure 3A:
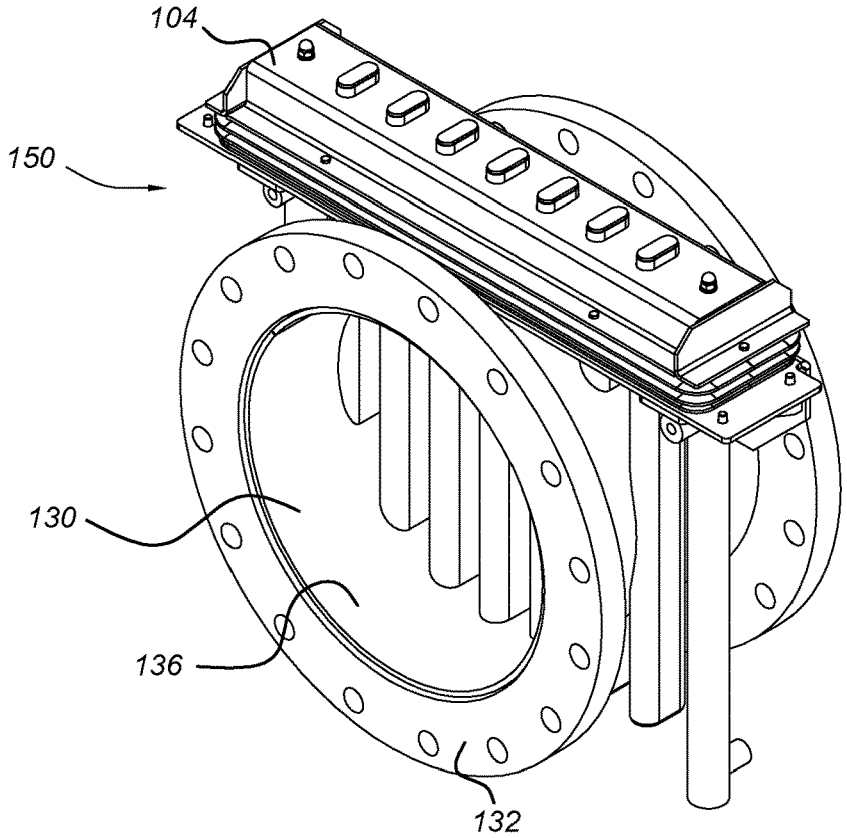
FIG. 3 shows a perspective view of a device for pre-magnetizing magnetizable particles according to the invention.
Figure 3B:
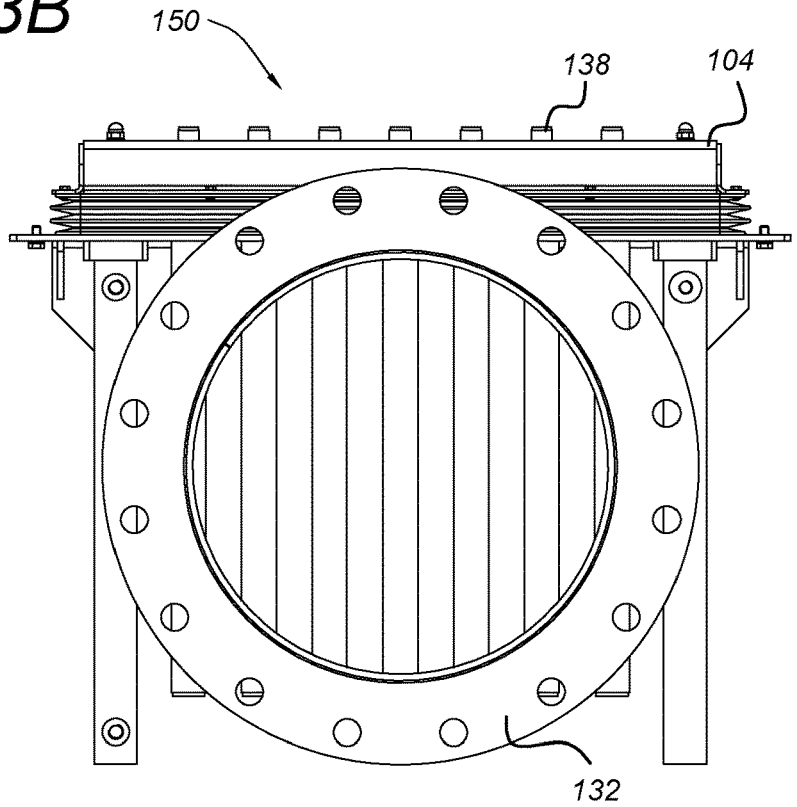
Figure 3C:
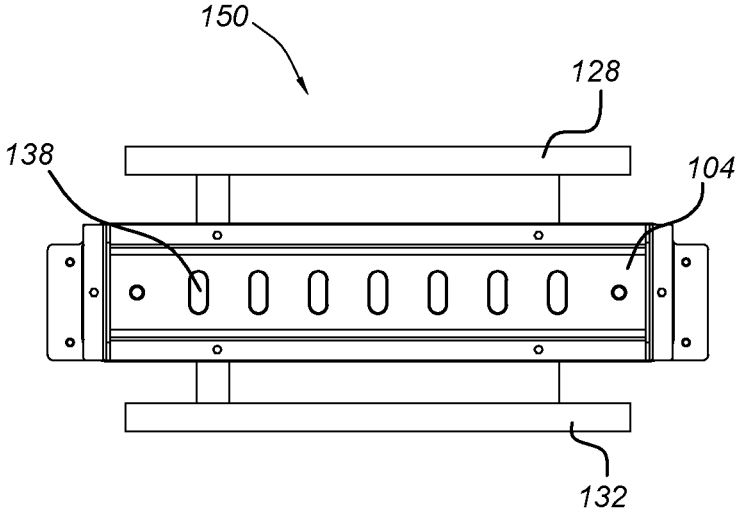
Figure 3D:
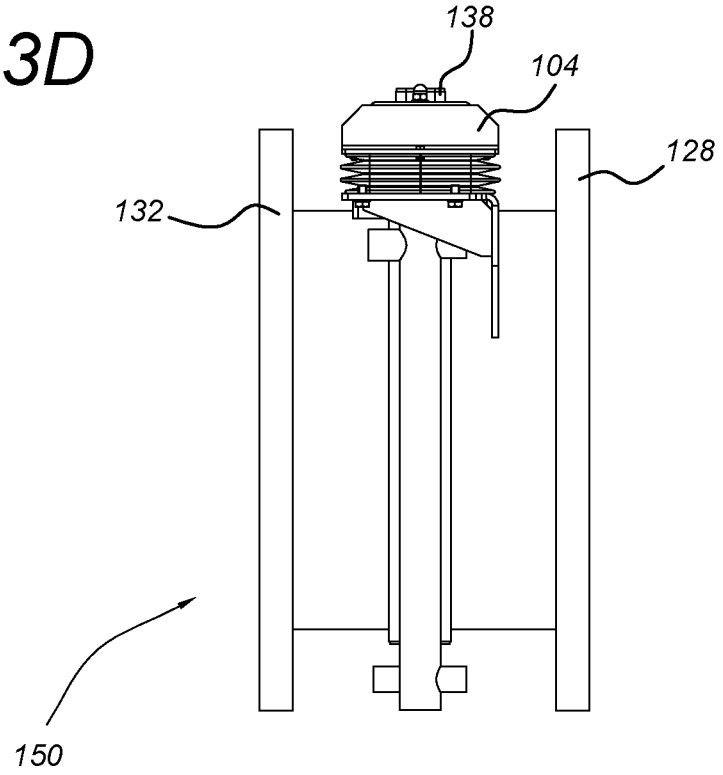

FIG. 1 shows a perspective view of an apparatus 100 for removing magnetizable particles in a substance, being a part of a magnetic separation system. FIG. 2 shows a cross section along line A-A of the apparatus of FIG. 1. The term 'substance' as used herein refers to any one of a liquid, gas, fluid, suspension, dry substance, or a mixture thereof. An exemplary embodiment is described with respect to a fluid substance, such as a liquid or gas, but it will be within the scope that a dry substance can be processed with the apparatus.

The apparatus 100 is a magnetic separator or filtration system comprising a magnetic separation or filter chamber 110 for filtering magnetizable particles and flocs from the substance, and a flocculation chamber 130, possibly comprised in a pre-magnetizing device 150, for inducing flocculation of the particles in the substance.

The magnetic separation chamber 110 comprises a first housing 112 that defines a first space 114 through which the substance can flow. The magnetic separation chamber further comprises a plurality of first magnets 116 of which a first magnetic field reaches into the first space 114. The first magnets 116 are each located within first holders 118 that have an interface 120 with the first space 114.

The flocculation chamber 130 comprises a second housing 134 that defines a second space 136 through which the substance can flow. In addition, the flocculation chamber 130 comprises a plurality of second magnets 138 of which second magnetic fields reach into the second space 136. The second magnets 138 are each located within second holders 140 that each have an interface 142 with the second space 136. The magnetic fields of the second magnets 138 causes the magnetizable parts in the substance to be attracted to each other, thereby undergoing flocculation and forming flocs.

The flocculation chamber 130 is in fluid connection with the magnetic separation chamber 110 through connection flanges 122 and 132, respectively, placing the magnetic separation chamber 110 and the flocculation chamber 130 adjacent to each other.

The magnetic separation chamber 110 is located downstream of and adjacent to the flocculation chamber 130. The flocculation of the magnetizable particles by means of pre-magnetization, results in magnetizable flocs. The magnetic field of the first magnets 116 causes the magnetizable flocs to be attracted towards the first magnets 116 thereby removing the flocs of magnetizable parts from the substance. The first space of the magnetic separation chamber defines a spatial volume which is greater than the spatial volume defined by the second space of the flocculation chamber, and which second space spatial volume is greater than the spatial volume of the conduit system. The spatial volume of a chamber defines the residence time of the substance in the chamber.

Figure 4:
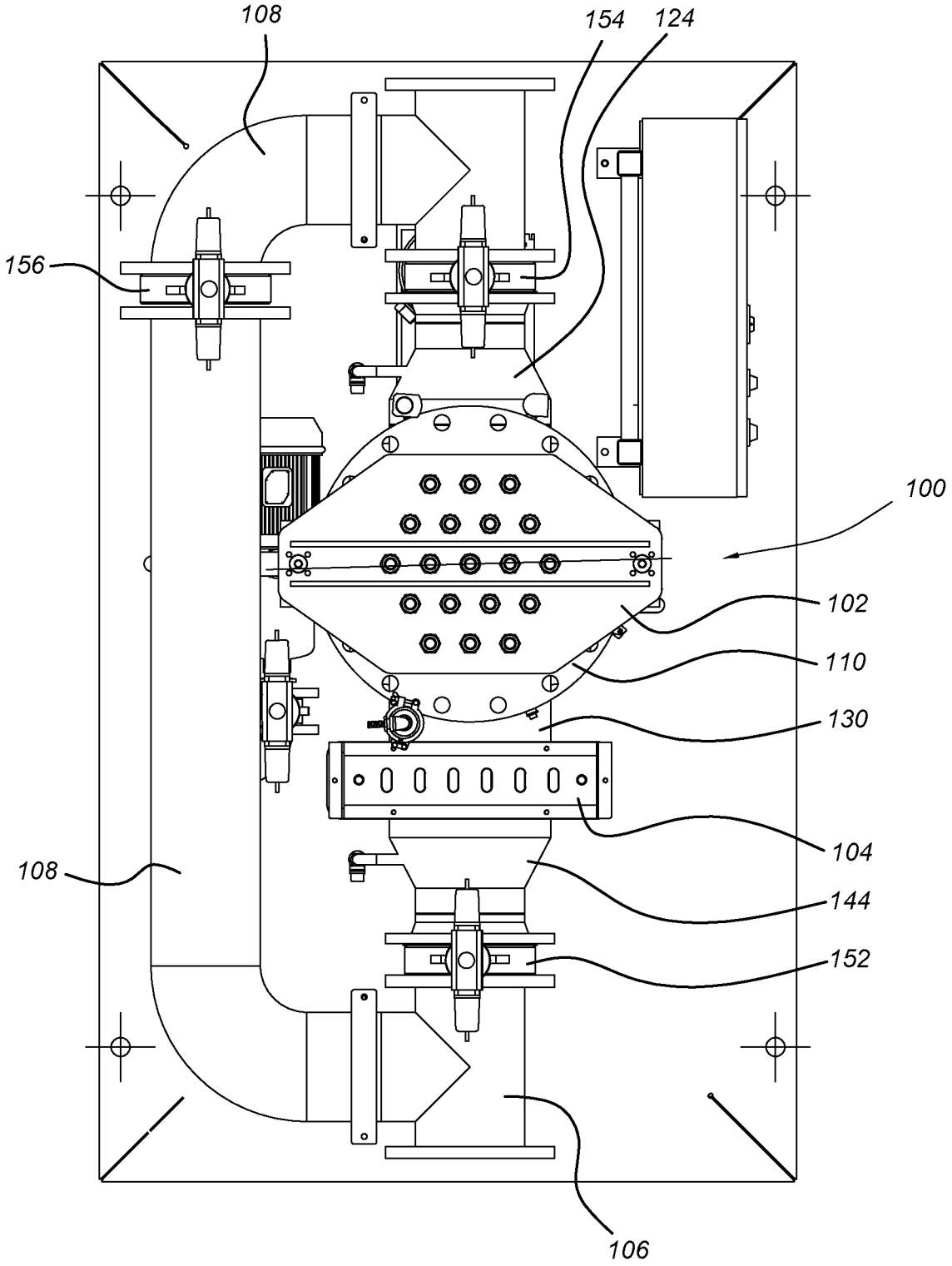
FIG. 4 shows a top view of a magnetic separation system comprising the apparatus of FIG. 1 including the bypass system.

The second housing 134 of the flocculation chamber 130 is provided with an inlet part 144 that is connectable to a conduit system 106, see FIG. 4, through which the substance flows. The first housing 112 of the magnetic separation chamber 110 is provided with an outlet part 124 that is connectable to the conduit system 106.

The inlet part 144 widens out to the flocculation chamber 130 to decrease a flow rate of the substance flowing into the flocculation chamber. As such, a first part 146 of the inlet part 144 has a diameter similar to that of the conduit system 106, and a second part 148 of the inlet part 144 tapers out to a larger diameter similar to the diameter of the flocculation chamber 130. The outlet part 124 tapers away from the magnetic separation chamber 110 to a diameter similar to that of the conduit system 106. In this embodiment the inlet part 144 and the outlet part 124 are arranged on different sides (such as opposite) of the magnetic separation chamber.

The first holders 118 of the magnetic separation chamber 110 extend into the first space 114, such that a longitudinal direction of the first holders 118 is substantially perpendicular to a downstream direction Du directed from the flocculation chamber 130 towards the magnetic separation chamber 110. Each first holder 118 comprises a tube that is closed at one end that is located in the first space 114. The first magnets 116 have a rod-like shape. Each rod-like first magnet 116 extends into one first holder 118 with a releasable fit, i.e. an air gap between an internal wall of the first holder and the first magnet 116. As the first magnets extend into the first space, a direction of the first magnetic fields is substantially perpendicular to the downstream direction Du.

The second holders 140 of the flocculation chamber 130 extend into the second space 136, such that a longitudinal direction of the second holders 140 is substantially perpendicular to a downstream direction Du directed from the flocculation chamber 130 towards the magnetic separation chamber 110. Each second holder 140 comprises a tube that is closed at one end that is located in the first space 136. The tube may even extend from a first side of the flocculation chamber 130 to beyond a second opposite side of the flocculation chamber 130, as shown in FIG. 2. The second magnets 138 have a rod-like shape. Each rod-like second magnet 138 extends into one second holder 140 with a releasable fit, i.e. an air gap between an internal wall of the second holder 140 and the second magnet 138. A longitudinal direction of the second holders is substantially perpendicular to the downstream direction Du from the flocculation chamber towards the magnetic separation chamber. As the second magnets 138 extend into the second space 136, a direction of the second magnetic fields is substantially perpendicular to the downstream direction Du.

The second magnets 138 have a cross section that has a greater dimension in the downstream direction Du with respect to a dimension in a direction transverse to the downstream direction, i.e. the major dimension is directed in the downstream direction. FIG. 1 shows that the cross section of the second magnets 138 is rectangular with rounded transverse edges, looking like a flattened ellipse or circle. The major dimension of the rectangular cross section is directed in the downstream direction. The cross section of the second holder 140 is similar to that of the second magnet 138, however with slightly larger dimensions to allow for an air gap between the second holder 140 and the second magnet 138.

The first magnets 116 have a circular cross section. The cross section of the first holder is similar to that of the first magnets, however with a slightly larger diameter to allow for an air gap between the first holder 118 and the first magnet 116.

The magnetic separation chamber 110 further comprises a cleaning system 126 to clean the inside of the first housing 112. The cleaning system 126 may comprise, a sprinkling or spraying member to clean the outside of each tube by spraying a fluidum towards the first holders 118. Said sprinkling or spraying member may comprise an annular pipe provided with a plurality of sprinkling or spraying nozzles which can be fed with a fluid, such as a liquid or gas. The nozzles can be situated in the first space 114 in various ways. According to FIG. 1, the nozzles are situated near the closed end of the tubes 118 in the first space 114, near the bottom of the first housing 112.

FIGS. 3*a*-3*d* show several views of a device 150 for pre-magnetizing magnetizable particles according to the invention (perspective, front view, side view, and top view, respectively). The device 150 comprises the flocculation chamber 130 for inducing flocculation of the particles in the substance. The flocculation chamber comprises the housing 134 that defines the second space 136 through which the substance can flow, as well as a plurality of second magnets 138 that extend into the second space 136, such that their magnetic fields reach into the second space 136. The magnets are located within the second holders 140 that each have an interface 142 with the second space 136.

The device 150 is connectable to the magnetic separation chamber 110 by means of connection flange 132. Further connection flange 128 can be used to connect the inlet part 144 to the flocculation chamber 130. The device 150 can be used for retrofitting an existing magnetic separation system or any other system, method, or technology for separation in need of a pre-magnetization treatment such as those involving hydro cyclone or multi cyclone technology.

FIG. 4 shows a top view of the magnetic separation system comprising the apparatus 100 of FIG. 1. The system further comprises a part of the conduit system 106 and a bypass system 108. The bypass system 108 is used at least during a cleaning process of the apparatus 100. The flow of substance through the apparatus 100 can be stopped by means of closure of a first valve 152 located before the inlet part, with respect to the flow direction of the substance. In addition, to avoid a backflow of the substance into the apparatus 100 while cleaning, a second valve 154 located downstream from the magnetic separation chamber 110 is closed as well, closing off the magnetic separation chamber 110. A third valve 156 provided at the bypass system 108, is opened to open the bypass system, such that the flow of substance bypasses the apparatus 100. FIG. 4 further shows a first movement mechanism 102 to move the first magnets 116 with respect to the first holders 118, and a second movement mechanism 104 to move the second magnets 138 with respect to the second holders 140.

Figure 5A:
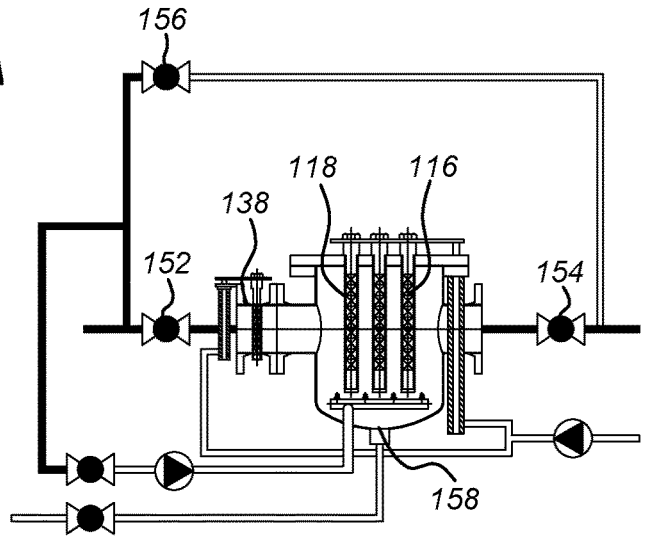
FIGS. 5*a*-5*f* show a schematic view of a magnetic separation process and a cleaning process.
Figure 5B:
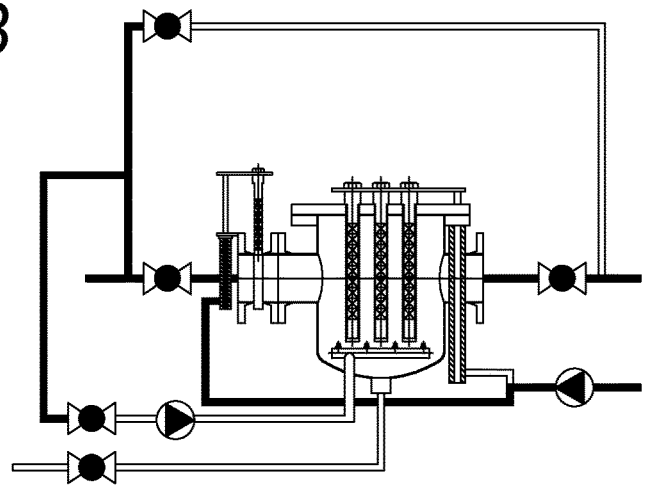

FIG. 5*a* shows a schematic view of an active magnetic separation system according to the invention, while the substance flows through the apparatus 100 and the magnetizable particles are separated from the substance by the apparatus 100. The first and second valves 152, 154 are open to allow the flow of the substance through the apparatus. The third valve 156 of the bypass system 108 is closed. The first magnets 116 are located in the first holders 118, and extend into the first space 114 of the magnetic separation chamber 130. The second magnets 138 are located in the second holders 140, and extend into the second space 136 of the flocculation chamber 130.

FIGS. 5*b*-5*e* show the system at various stages of a cleaning process. In a first step 5*b* of the cleaning process the first and second valves 152, 154 are open and the third valve 156 is closed (thus fluid flows through the unit). Only the second magnets are raised so that any captured particles will be forced by the fluid flow into the magnetic separation chamber where they will be captured by the first magnetic field.

Figure 5C:
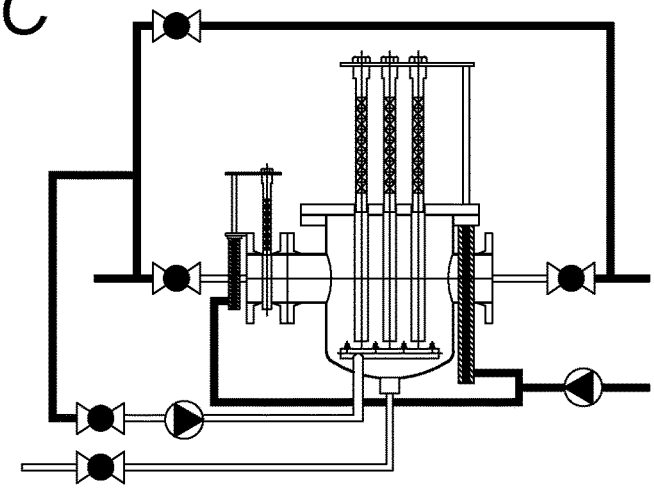

FIG. 5*c* shows a schematic view of a magnetic separation system according to the invention during a further step of the cleaning process. The first and second valves 152, 154 are in their closed position, stopping the flow of substance through the apparatus 100. The third valve 156 is in its open position, allowing the substance to flow through the bypass system 108.

Additionally, the second magnets 138 and the first magnets 116 have been removed from the second and first holders, respectively, by the first and second movement mechanism 102, 104, respectively. The movement mechanisms 102, 104 can be hydraulically actuated, but other forms of actuation may be used as well. For the apparatus of FIGS. 1-5, the movement mechanisms 102, 104 raise the magnets with respect to the respective holders. This direction of movement with respect of the holders of course depends on the orientation of the holders and the apparatus and may be in any horizontal and/or vertical direction applicable.

Figure 5D:
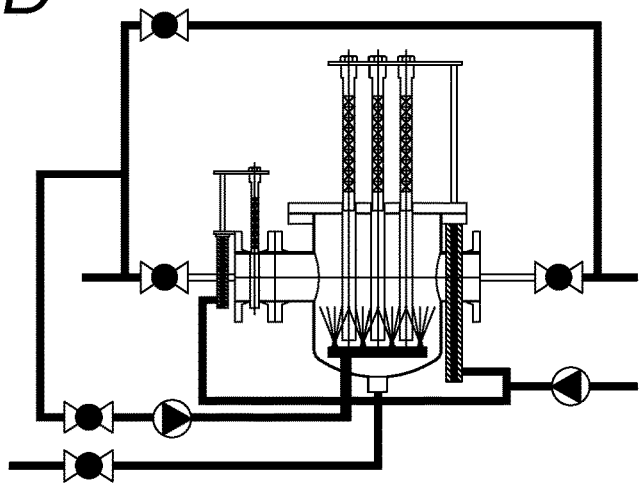

FIG. 5*d* shows a schematic view of the magnetic separation system according to the invention during the cleaning process. The first and second magnets 116, 138 have been raised from the respective holders 118, 140. When the magnets 116, 138 are raised out of their holder, the strengths of the magnetic fields in the first and second spaces decrease considerably, as a result of which the particles and/or flocs accumulated on the outside of the holders can easily be removed. In order to ensure that the particles or flocs do not enter the cleaned liquid again, the bottom wall of the first housing 112 is provided with a discharge 158 for removing the magnetizable parts which accumulated on the outside of each tube.

Despite the removal of the magnets, some particles may nevertheless remain behind on the holder wall. In order to be able to remove these particles reliably, the sprinkling or spraying member for cleaning the outside of each tube is situated near the bottom end of each tube. The spraying member is part of the cleaning system and sprays a fluid (liquid or gas) towards the tubes to remove any particles left on the holder wall. The sprayed-off particles are then removed from the magnetic separation chamber 110 through the discharge 158.

Figure 5E:
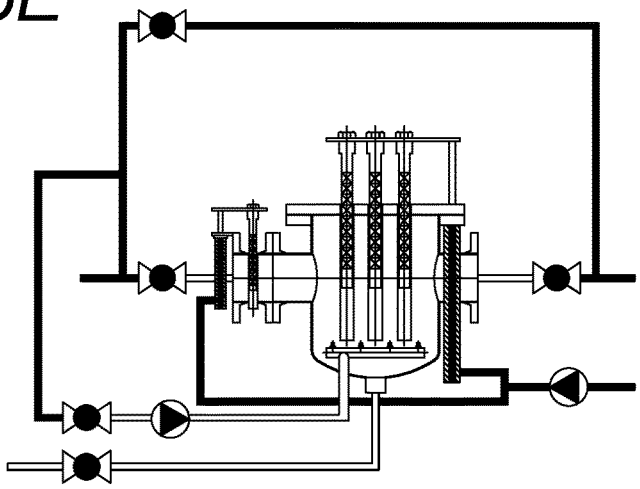

FIG. 5*e* shows a schematic view of a magnetic separation system according to the invention during finishing of the cleaning process. The first and second magnets 116, 138 are lowered again by the respective movement mechanisms 102, 104 into their respective holders 118, 140. While lowering the magnets, the first and second valves 152, 154 remain closed and the third valve 156 remains open. The discharge 158 is closed as well. Only when the magnets are fully lowered into their holders, will the first and second valves be opened and the third valve be closed again. Then the substance will flow through the apparatus 100 again and the magnetizable particles will undergo flocculation and separation, subsequently, according to FIG. 5*a*.

Figure 5F:
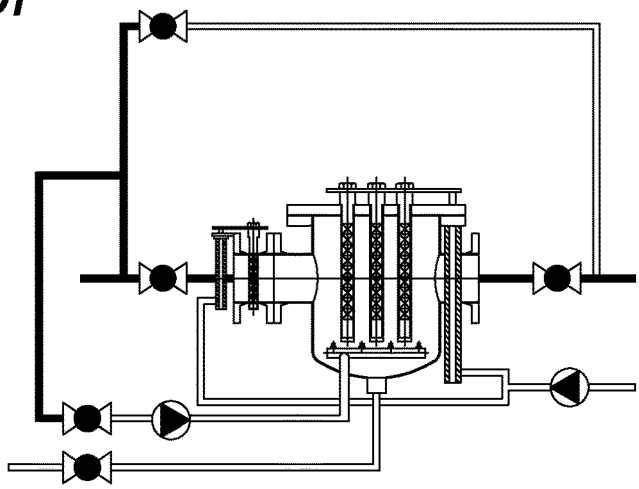

FIG. 5*f* shows a schematic view of a magnetic separation system according to the invention during active filtration, after the cleaning process is finished.

Figure 6A:
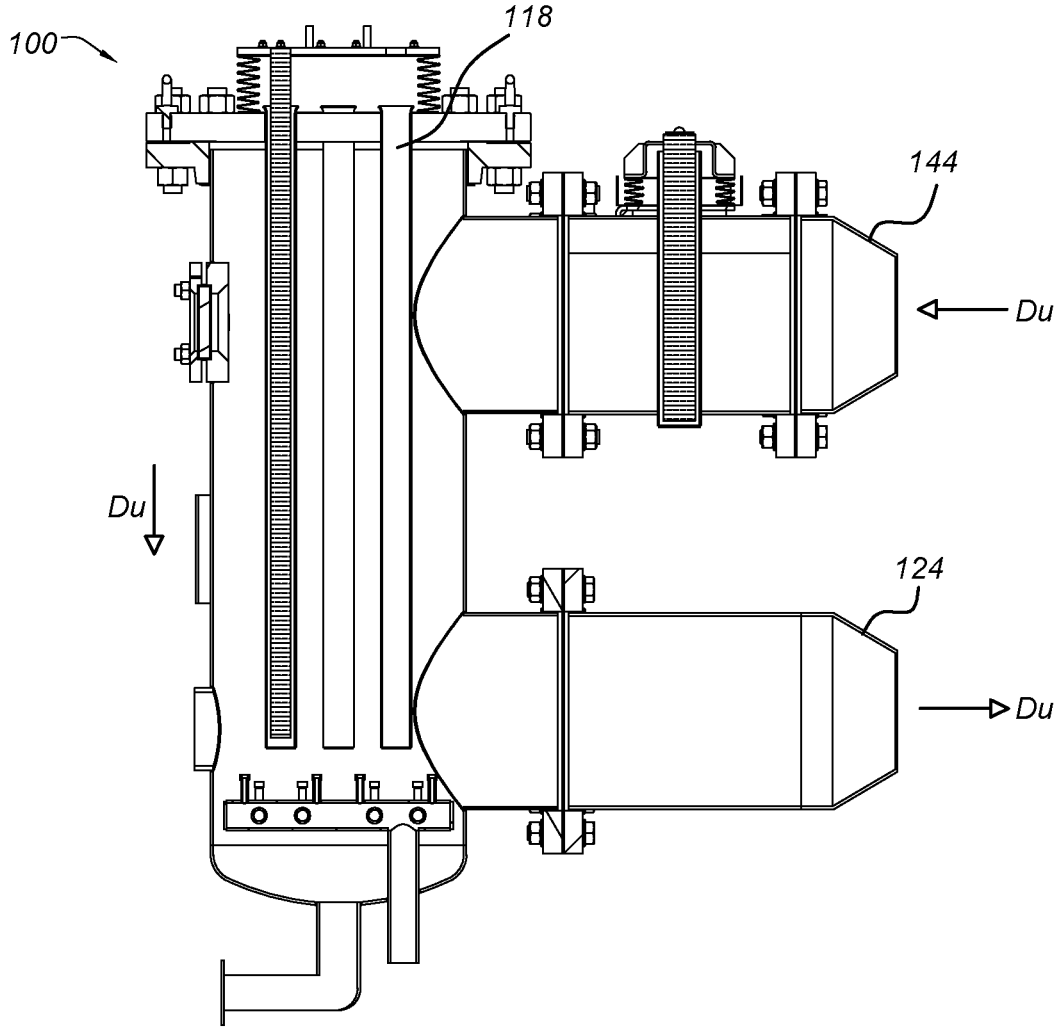
FIGS. 6*a*-6*b* shows a schematic view of a magnetic separation system according to the invention, wherein the holders, magnets, and magnetic fields are arranged substantially parallel to the flow direction.
Figure 6B:
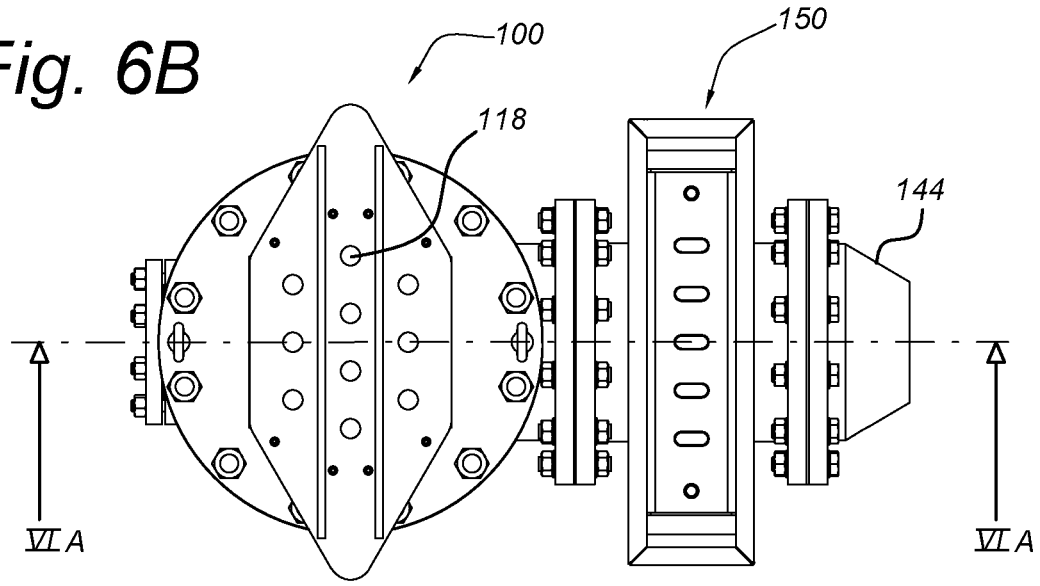
Figure 6C:
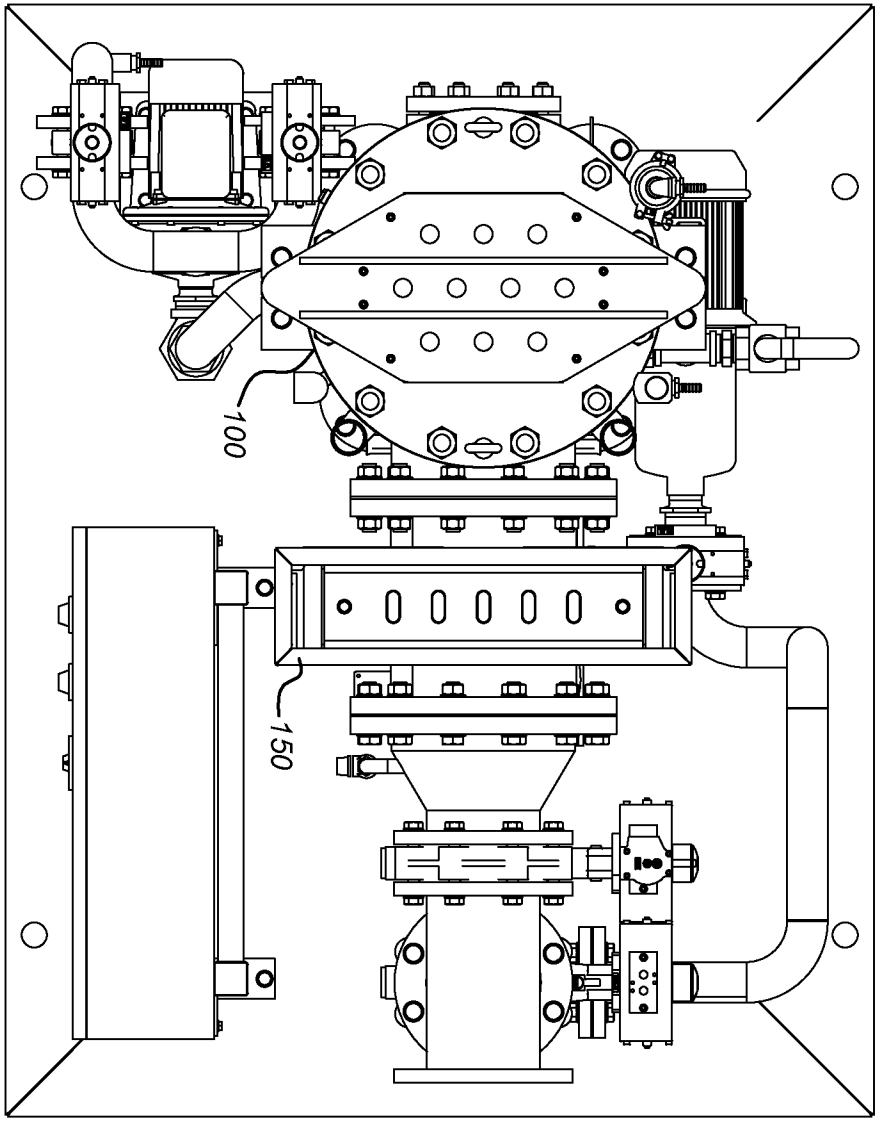
FIG. 6*c* shows a top view.

FIGS. 6*a*-6*b* show a cross-section A-A and a top view, respectively, of an embodiment wherein the magnetic elements are arranged in substantially parallel orientation with respect to the general direction of the substance flow (downstream direction Du), while FIG. 6*c* shows a top view of this embodiment connected to the conduit and bypass system. The flow in this embodiment enters the magnetic separation chamber via an inlet 144 and via the flocculation chamber 130. The substance flows downward through the magnetic separation chamber and exits via the outlet 124. FIGS. 6*a*-6*b* show the inlet part 144 and the outlet part 124 are both arranged on the same side of the magnetic separation chamber. Alternatively, the inlet part 144 and the outlet part 124 may be arranged on different (such as opposite) sides of the magnetic separation chamber. Moreover, it is noted herein that Du can alternatively flow in a different direction from the one depicted in the figure. For example, the elements can be arranged such that Du flows in a direction opposite as the depicted direction. In that case the function of the shown elements 124 and 144 would be respectively inverted, with the shown outlet 124 assuming an inlet function, and the shown inlet 144 assuming an outlet function.

Figure 7A:
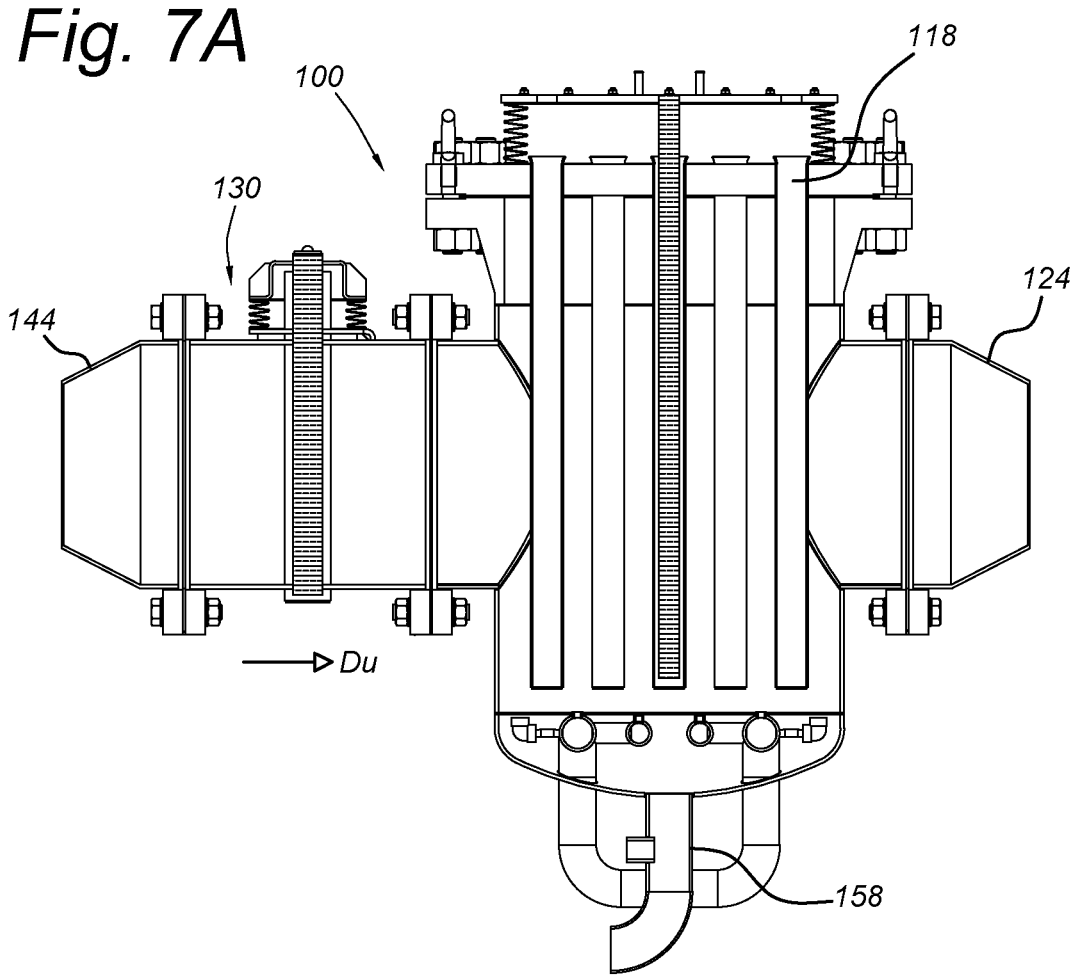
FIGS. 7*a*-7*c* shows a further schematic view of a magnetic separation system according to the invention, wherein the holders, magnets, and magnetic fields are arranged substantially perpendicular to the flow direction, in which a draining outlet is visible.
Figure 7B:
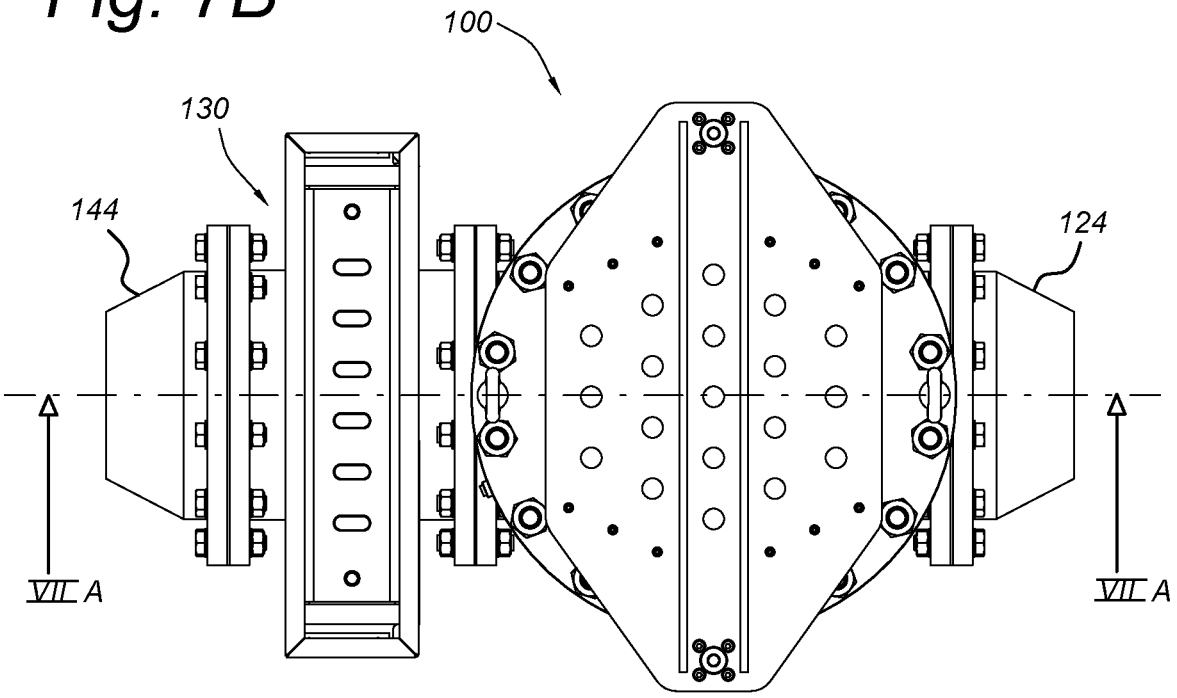
Figure 7C:
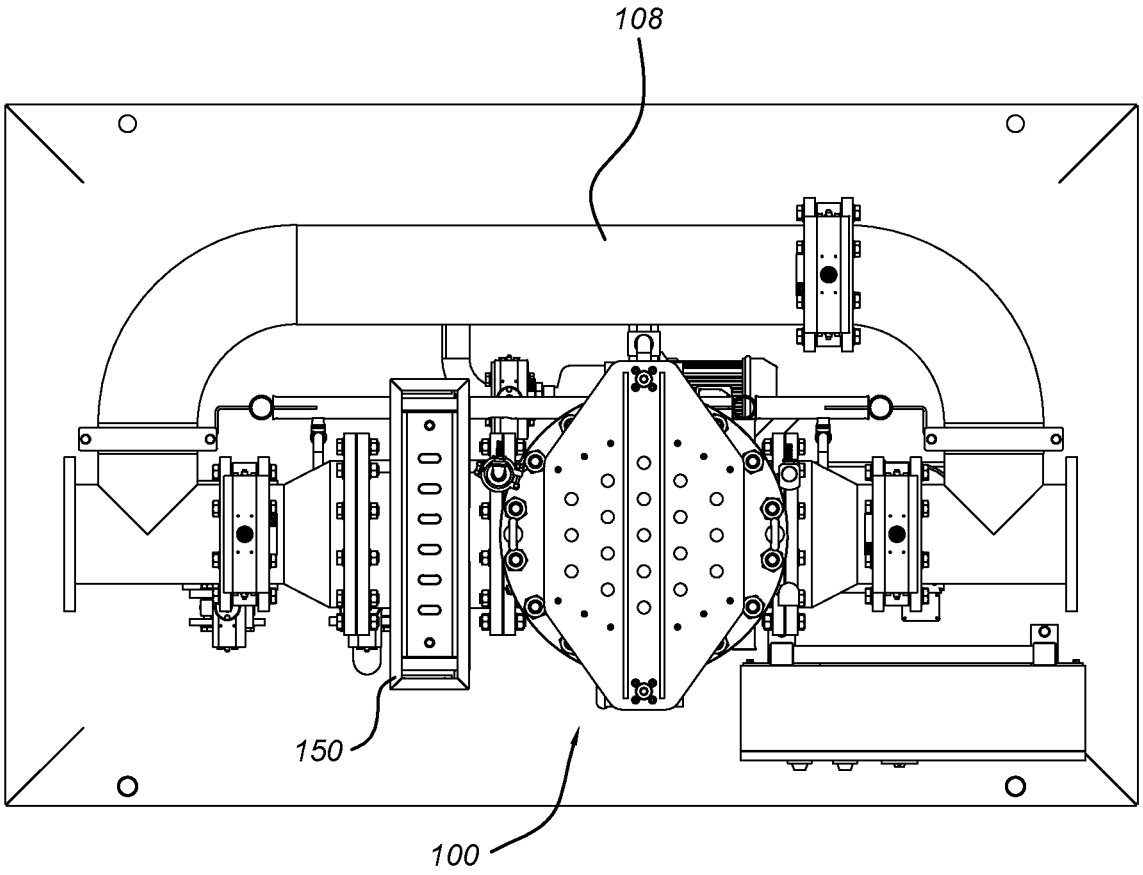

FIGS. 7*a*-7*b* show a cross-section A-A and a top view, respectively, of an embodiment of the magnetic separation system according to the invention wherein the magnets are arranged in perpendicular orientation to the general direction of the substance flow. FIG. 7*c* shows a view of the magnetic separation system with a bypass element 108. A draining outlet 158 is shown in FIG. 7*a*, which functions to drain residue during the cleaning process.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

LIST OF PARTS

100. Apparatus/system
102. First moving mechanism
104. Second moving mechanism
106. Conduit system
108. Bypass system
110. Magnetic separation chamber
112. First housing
114. First space
116. First magnet
118. First holder
120. First interface
122. Connection flange
124. Outlet part
126. Cleaning system
128. Further connection flange
130. Flocculation chamber
132. Connection flange
134. Second housing
136. Second space
138. Second magnet
140. Second holder
142. Second interface
144. Inlet part
146. First part of inlet
148. Second part of inlet
150. Pre-magnetizing device
152. First valve
154. Second valve
156. Third valve
158. Draining outlet

The invention claimed is:

1. An apparatus for removing magnetizable particles in a substance, the apparatus comprising:

a magnetic separation chamber for filtering magnetizable particles and flocs from the substance, wherein the magnetic separation chamber comprises a first housing that defines a first space through which the substance can flow, as well as at least one first magnet of which a first magnetic field reaches into the first space, and which first magnet is located within a first holder that has an interface with the first space; and a flocculation chamber for inducing flocculation of the particles in the substance, the flocculation chamber being in fluid connection with the magnetic separation chamber, characterized in that the flocculation chamber comprises a second housing that defines a second space through which the substance can flow, as well as at least one second magnet which is located within a second holder that has an interface with the second space, wherein each second holder comprises a tube that is closed at an end that extends into the second space, wherein a second magnetic field of said second magnet reaches into the second space, and wherein the magnetic field of the second magnet causes the magnetizable particles to be attracted to each other, thereby undergoing flocculation and forming flocs in the flocculation chamber, wherein the magnetic separation chamber is located completely downstream of the flocculation chamber, wherein the flocculation chamber is arranged immediately adjacent to the magnetic separation chamber, and wherein the flocculation of the magnetizable particles in the flocculation chamber results in magnetizable flocs, and the magnetic field of the first magnet causes the magnetizable flocs to be attracted towards the first magnet, thereby removing the flocs of magnetizable particles from the substance.

2. The apparatus of claim 1, wherein:

the second holder of the second magnet has an oval cross section, wherein a major axis of the oval cross section is directed in the downstream direction; and/or each first holder comprises a tube that is closed at an end that extends into the first space so that magnetizable particles or flocs may accumulate on the outside of the first holder.

3. The apparatus of claim 1, wherein the flocculation chamber and the magnetic separation chamber are integrally formed.

4. The apparatus of claim 1, wherein a cross section of the second holder of the second magnet has a greater dimension in the downstream direction with respect to a dimension in a direction transverse to the downstream direction.

5. The device of claim 1, wherein the magnetic separation chamber has a connection flange through which the substance can flow, wherein the flocculation chamber has a connection flange through which the substance can flow, the flocculation chamber and magnetic separation chamber being in fluid connection through said connection flanges, and wherein the connection flange of the magnetic separation chamber is adjacent and connected to the connection flange of the flocculation chamber.

6. The apparatus of claim 1, wherein the first and/or second magnets have a rod shape, and which first and/or second magnets have a releasable fit into the first and/or second holder.

7. The apparatus of claim 1, wherein the first and/or second holder has a top side outside of the first and/or second space from which each tube extends into the first and/or second space, respectively.

8. The apparatus of claim 1, wherein the first and/or second magnets are connected to a moving mechanism to move the first and/or second magnet with respect to the first and/or second space, respectively.

9. The apparatus of claim 1, wherein the housing of the flocculation chamber is provided with an inlet part that is connectable to a conduit system through which the substance flows, and wherein the housing of the magnetic separation chamber is provided with an outlet part that is connectable to the conduit system.

10. The apparatus of claim 1, wherein the first space of the magnetic separation chamber defines a spatial volume which is greater than the spatial volume defined by the second space of the flocculation chamber.

11. The apparatus of claim 1, wherein:

a longitudinal direction of the first and/or second holders is substantially perpendicular, parallel, or a combination thereof to a downstream direction from the flocculation chamber towards the magnetic separation chamber; and/or a direction of the first and/or second magnetic fields is substantially perpendicular, parallel, or a combination thereof to the downstream direction.

12. The apparatus of claim 1, wherein the housing of the magnetic separation chamber further comprises a removable attachment, wherein the magnets of the magnetic separation chamber are connected to the attachment, and wherein the housing further comprises holders for holding the magnets.

13. Device for pre-magnetizing magnetizable particles, the device comprising a flocculation chamber for inducing flocculation of the particles in a substance, the flocculation chamber being fluidly connectable to a magnetic separation chamber located downstream from the flocculation chamber, wherein the flocculation chamber comprises a housing that defines a space through which the substance can flow, as well as at least one magnet of which a magnetic field reaches into the space, and which magnet is located within a holder that has an interface with the space, said holder comprising a tube that is closed at an end that extends into the space;

wherein a cross section of the holder of the magnet has a greater dimension in the downstream direction with respect to a dimension in a direction transverse to the downstream direction; and wherein the magnetic field of the magnet causes the magnetizable particles to be attracted to each other, thereby undergoing flocculation and forming flocs.

14. The device of claim 13, further comprising:

an inlet part that is connectable to a conduit system through which the substance flows; and one or more flanges for connection to the magnetization chamber.

15. The device of claim 14, wherein the housing comprises a flange on a first side, for connecting to an inlet part that is connectable to a conduit system and a flange on a second, opposite side, for connecting to the magnetic chamber.

16. A method of removing magnetizable particles from a substance, the method comprising the steps of inducing flocculation of the magnetizable particles in the substance to produce flocs by providing a second magnetic field applied in a flocculation chamber, wherein the flocculation has a connection flange through which the substance can flow, wherein the flocculation chamber comprises a housing that defines a second space through which the substance can flow, as well as at least one magnet which is located within a holder that has an interface with the space, wherein each holder comprises a tube that is closed at an end that extends into the space, wherein a magnetic field of said magnet reaches into the space, and wherein the magnetic field of the magnet causes the magnetizable particles to be attracted to each other, thereby undergoing flocculation and forming flocs in the flocculation chamber;

providing a first magnetic field in a magnetic separation chamber in order to magnetize the flocs and single particles, wherein the magnetic separation chamber is arranged immediately adjacent to and completely downstream of the flocculation chamber, and wherein the magnetic separation chamber has a connection flange through which the substance can flow, the flocculation chamber and magnetic separation chamber being in fluid connection through said connection flanges, wherein the connection flange of the magnetic separation chamber is adjacent and connected to the connection flange of the flocculation chamber;

conveying the substance from the flocculation chamber through the magnetic separation chamber to remove the magnetized flocs and single particles from the substance.

17. The method of claim 16, wherein the step of inducing flocculation comprises providing a second magnetic field applied in the flocculation chamber.

18. The method of claim 16, further comprising the step of reducing the flow velocity of the substance prior to and/or during the step of forming flocs and during the step of separation in the magnetic separation chamber.

19. The method of claim 16, further comprising cleaning the magnetic separation chamber and/or the flocculation chamber, wherein said cleaning any of the chambers comprises removing the respective magnets from the chamber.

20. The method of claim 16, using the apparatus of claim 1 for removing magnetizable particles in the substance.

* * * * *